US006052863A

United States Patent [19]

Rittmueller et al.

[11] Patent Number: 6,052,863

[45] **Date of Patent: *Apr. 25, 2000**

[54] CENTRAL VACUUM CLEANER MUFFLER

[75] Inventors: Stephen P. Rittmueller, St. Charles, Ill.; J. Adin Mann; David K. Holger, both of Ames, Iowa; Douglas E. Johnson, Webster City, Iowa

[73] Assignees: Iowa State University Research Foundation, Inc., Ames, Iowa; White Consolidated Industries, Inc., Cleveland, Ohio

[ * ] Notice: Under 35 U.S.C. 154(b), the term of this patent shall be extended for 308 days.

[21] Appl. No.: 08/546,116

[22] Filed: Oct. 20, 1995

[51] Int. Cl.[7] ..... A47L 9/00

[52] U.S. Cl. ..... 15/326; 55/276

[58] Field of Search ..... 15/326; 55/276

[56] References Cited

U.S. PATENT DOCUMENTS

| | | | |
|---|---|---|---|
| 3,882,961 | 5/1975 | Cannan et al. | 55/276 X |
| 4,015,683 | 4/1977 | Williams | 15/326 X |
| 4,241,720 | 12/1980 | Kitchen | 126/110 |
| 4,435,877 | 3/1984 | Berfield | 15/326 |
| 4,662,910 | 5/1987 | Lieb | 55/276 |
| 4,718,924 | 1/1988 | DeMarco | 55/302 |
| 4,759,422 | 7/1988 | Belley | 15/326 X |
| 4,786,299 | 11/1988 | DeMarco | 55/276 |
| 5,400,463 | 3/1995 | Attard et al. | 15/326 |
| 5,471,707 | 12/1995 | Kang | 15/326 |

FOREIGN PATENT DOCUMENTS

| | | | |
|---|---|---|---|
| 113173 | 10/1978 | Japan | 15/326 |
| 117262 | 10/1978 | Japan | 15/326 |

*Primary Examiner*—Chris K. Moore

[57] ABSTRACT

A central vacuum cleaner having an air flow exhaust pipe is provided with a muffler comprising an elongated muffler pipe having a reduced diameter inlet and a reduced diameter outlet and a noise reducing foam liner disposed in the muffler pipe between the inlet and outlet. The foam liner includes a smooth inner surface that is generally flush with inner surfaces of the inlet and outlet. The foam liner comprises a combustion modified polyether polyurethane foam tube inserted in the muffler pipe between the inlet and outlet.

7 Claims, 2 Drawing Sheets

CENTRAL VACUUM CLEANER MUFFLER

FIELD OF THE INVENTION

The present invention relates to a muffler for a central vacuum cleaner unit to reduce exhaust noise.

BACKGROUND OF THE INVENTION

Central vacuum cleaner units are in widespread use in households and in myriad commercial facilities. Typically, the central vacuum cleaner unit is located in a permanent position with one or more suction tubes extending from the central unit and routed through the walls of the home or building to rooms to be vacuumed.

A major complaint voiced about such central vacuum cleaner units has been the relatively high level of exhaust air noise that they generate for occupants of the home or building in which the unit is disposed as well as for neighbors of homes or buildings adjacent the exhaust of the unit. Exhaust air noise is one of the major noise sources of the unit.

An object of the present invention is to provide a muffler for a central vaccum cleaner unit wherein the muffler is effective to reduce exhaust air noise output of the unit by reducing noise originating from inside the unit and by reducing noise created by high velocity exhaust air flow.

Another object of the present invention is to provide a muffler for a central vacuum cleaner wherein the muffler provides a combination of features including improved exhaust noise reduction, minimal material usage, and minimal flow induced noise within the muffler.

SUMMARY OF THE INVENTION

The present invention provides a central vacuum cleaner having an air flow exhaust pipe and a muffler communciated to the exhaust air flow pipe. The muffler comprises an elongated muffler pipe having an inlet and outlet and a foam liner disposed in the muffler pipe between the inlet and outlet. The foam liner includes a smooth inner surface that is substantially flush with inner surfaces of the inlet and outlet.

In one embodiment of the present invention, the muffler pipe comprises opposite ends, an end cap connected to each end, and a reduced diameter inlet tube and reduced diameter outlet tube on a respective end cap. The foam liner comprises a noise absorbing open cell foam liner inserted in the muffler pipe between the inlet and outlet tubes.

The foam liner limits exhaust air noise originating from inside the unit by virtue of having an inner surface substantially flush with the inner surfaces of the inlet and outlet and by having a smooth inner surface over which high velocity exhaust air flow exits. The length of the muffler pipe/foam liner is selected in conjunction with the other muffler components to be sufficient to achieve substantial exhaust air flow noise reduction.

The present invention and its objects will be explained in more detail by reference to the following detailed description and the following drawing.

DESCRIPTION OF THE INVENTION

Figure 1:
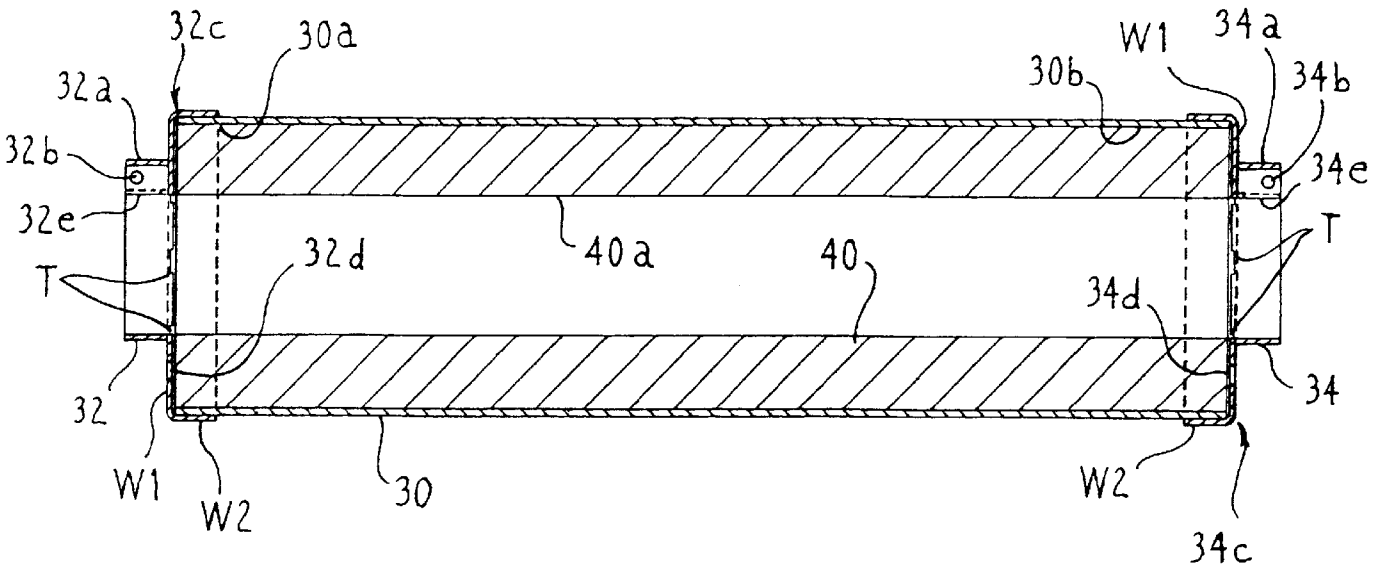
FIG. 1 is a longitudinal sectional view taken along line 1—1 of FIG. 2 of a muffler of a central vacuum cleaner unit in accordance with an embodiment of the present invention.
Figure 2:
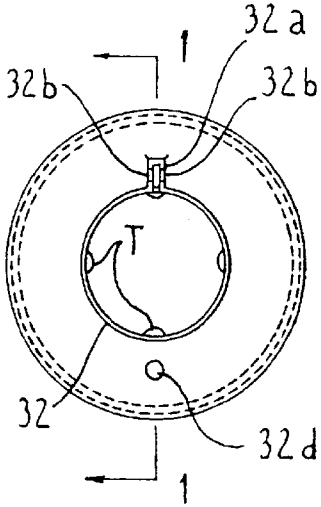
FIG. 2 is an end elevation of the of the muffler of FIG. 1.
Figure 3:
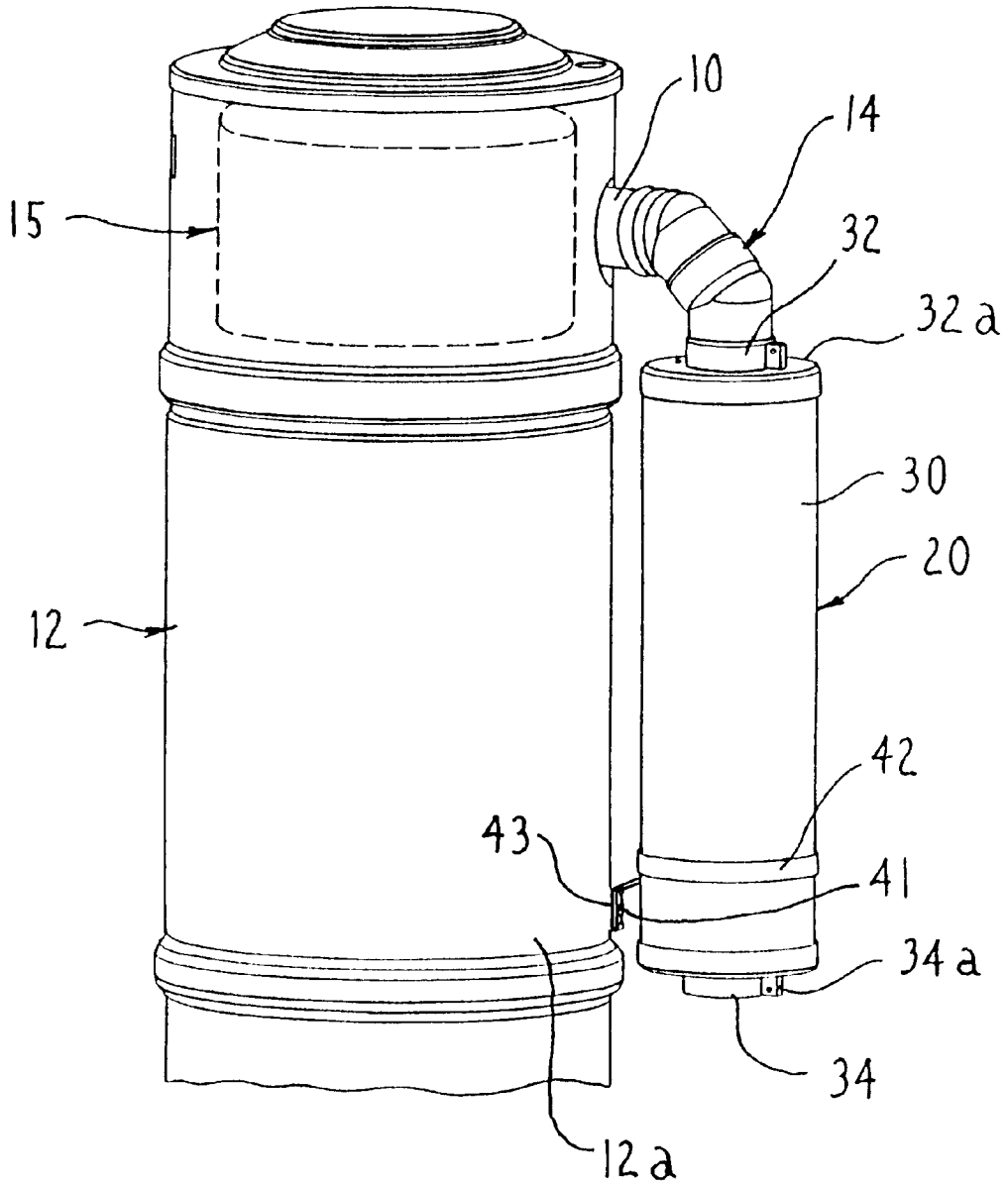
FIG. 3 is a perspective view of a central vacuum cleaner and muffler of the present invention oriented vertically.

Referring to FIGS. 1–3, the exhaust air flow pipe 10 of a central vacuum cleaner 12 (shown schematically) is illustrated and shown communicated via an exhaust elbow conduit 14 to a noise reduction muffler 20 in accordance with an embodiment of the present invention.

The central vacuum cleaner 12 can be of conventional type, such as the Model 297C unit manufactured by Beam Industries, Webster City, Iowa. The central vacuum cleaner 12 is located in a permanent position within the home or building, such as in the basement or in a closet as is well known. The central vacuum cleaner 12 includes a vacuum motor 15 (shown schematically) that generates a high velocity exhaust air flow through the exhaust air flow pipe 10 and elbow conduit 14. For example, the velocity of the air flow through the exhaust air flow pipe 10 typically is from 30 to 200 cubic feet per minute.

The exhaust air flow pipe 10 of the central vacuum cleaner 12 is communicated to the exhaust elbow conduit 14 which is communicated to the noise reduction muffler 20 such that the high velocity exhaust air flow exits through the muffler. The muffler 20 comprises an elongated central muffler pipe 30 having a relatively large cross sectional dimension, such as diameter, as compared to that of an end cap inlet tube 32 and end cap outlet tube 34. That is, the end cap inlet and outlet tubes 32, 34 have a reduced cross sectional dimension, such as diameter, relative to that of the muffler pipe 30. For example, a cylindrical muffler pipe 30 can have an inner diameter of 4 inches and outer diameter of 4.215 inches. The inlet and outlet tubes 32, 34 can have an inner diameter of approximately 2 inches and outer diameter of 2.16 inches. The reduced diameter inlet and outlet tubes 32, 34 can have different cross sectional dimensions (e.g. diameters) within the practice of the invention.

The inlet and outlet tubes 32 and 34 are each formed (e.g. molded) with a bifurcated extension region 32*a* and 34*a* that includes a pair of axially aligned holes 32*b*, 34*b* for receivng a threaded bolt (not shown) which is secured by a nut (not shown) placed on the threaded bolt. The nut can be tightened (threaded) on the bolt in a manner to clamp the tube 32 on the elbow conduit 14 as, for example, in FIG. 3 and to clamp tube 34 on an optional exhaust pipe (not shown) that extends outside the building.

The inlet and outlet tubes 32 and 34 are formed integrally with end caps 32*c* and 34*c*. The end caps 32*c* and 34*c* each include an end wall W1 and a cylindrical side wall W2 that define respective chambers in which the ends of the muffler pipe 30 are received. The side walls W2 are solvent welded to the muffler pipe 30 to form an assembly. The wall W1 defines an opening communicating the tubes 32, 34 to the muffler pipe 30. The wall W1 includes circumferentially spaced radially extending tabs T to prevent the elbow conduit 14 or exhaust air flow pipe 10 from entering the muffler 20. Each end wall W1 includes a reduced-thickness wall section 32*d*, 34*d* that can be broken out during installation of the muffler 20 to provide a wire passage for a low-voltage wire (not shown) when the end cap is used as a so-called dress-up collar; i.e. when the end-cap is disposed about the exhaust pipe 10 adjacent a wall of structure pierced by the pipe 10 to hide the hole cut in the wall of the structure to receive the pipe 10.

The muffler pipe 30 and inlet and end cap outlet tubes 32, 34 preferably comprise PVC plastic sewer pipe pursuant to ASTM specification D2729. However, the invention is not limited to PVC pipe or tubing and can be practiced using other pipe and tube materials.

The muffler 20 can be communicated to the exhaust air flow pipe 10 by clamping the inlet pipe 10 to the elbow conduit 14 and disposed in a vertical orientation as shown in FIG. 3. In this vertical installation, the lower region of the muffler pipe 30 is mounted on the housing 12*a* of the vacuum cleaner 12 by a clip 41, clip strap 42 disposed about the housing 12*a*, and foam adhesive tape 42 between the clip 41 and the housing 12*a*. Alternately, the muffler 20 can be connected to the exhaust air flow pipe 10 in a horizontal orientation by clamping the tube 32 of the muffler pipe 30 on the pipe 10 and supporting the end of the muffler 20 remote from the the vacuum cleaner housing 12*a* to a wall or other support structure (not shown). The outlet tube 34 extends directly to the exterior of the home or building for exhaust purposes, or alternately is connected to a suitable separate exhaust pipe to this end.

A foam liner 40 is disposed in the muffler pipe 30 between its opposite axial ends 30*a*, 30*b*. The foam liner 40 includes a smooth inner surface 40*a* having, for example, a smoothness measured to be about 65 pores per lineal inch (ppi) and positioned substantially flush with the inner surfaces 32*e*, 34*e* of the inlet and outlet tubes 32, 34 as shown in FIG. 1. In the embodiment of the invention discussed hereabove using the 4 inch inner diameter PVC muffler pipe 30 and 2 inch inner diameter PVC inlet and outlet tubes 32, 34, the foam liner 40 has an inner diameter of 2 inches and outer diameter of 4 inches with a radial wall thickness of about 1 inch such that the smooth inner liner surface 40*a* is substantially flush with the inner inlet and outlet surfaces 32*e*, 34*e*.

The foam liner 40 preferably is a preformed (premolded) tubular member and is positioned in the muffler pipe 30 before the end caps 32*c*, 34*c* with integral tubes 32, 34 are connected thereto, although the invention is not so limited and can be practiced using a foamed in place foam liner.

The noise-absorbing foam liner preferably comprises a combustion modified polyetherpolyurethane available commercially as Char HyFonic 1 foam available from Stephenson & Lawyer located at 3831 Patterson Ave., S.E., Grand Rapids, Mich. This foam exhibits a fine, open pore structure of about 65 ppi that renders the foam liner 40 effective for noise reduction when the high velocity exhaust air flow exits the muffler 20.

The substantial flushness of the inner surface 40*a* of the foam liner 40 with the inner surfaces 32*e*, 34*e* of the inlet and outlet tubes 32, 34 and the smoothness of the inner liner surface 40*a* function to reduce or minimize air flow induced noise in the muffler 20. The length of the foam liner 40 and muffler pipe 30 preferably is selected at a minimum length necessary to achieve substantial exhaust air flow noise reduction (i.e. a longer muffler length would gain little more in noise reduction). In this way, the size of the muffler 20 and the materials used in its construction are minimized to reduce space and material cost requirements of the muffler. In the embodiment of the invention discussed hereabove using the 4 inch inner diameter PVC muffler pipe 30 and 2 inch inner diameter PVC inlet and outlet tubes 32, 34, the muffler pipe 30 and foam liner 40 have a length of about 15 inches to this end.

The muffler 20 described hereabove is effective to substantially reduce the exhaust air flow noise level of the central vacuum cleaner. For example, in the embodiment of the invention discussed hereabove using the 4 inch inner diameter PVC muffler pipe 30 and 2 inch inner diameter PVC inlet and outlet tubes 32, 34 with the muffler pipe 30 and foam liner 40 having a length of about 15 inches, the exhaust air flow noise level of the aforementioned model 297 central vacuum cleaner was reduced to 62.88 decibels from 79.93 decibels.

Although a particular embodiment of the invention has been described in detail hereabove for purposes of illustration, it will be understood that variations and modifications can be made in therein within the scope of the invetnion as set forth in the appended claims.

What is claimed is:

1. A central vacuum cleaner having a muffler communicated in air flow relation to an exhaust air flow pipe, said muffler comprising an elongated muffler pipe having inlet and outlet tubes and a foam liner disposed in said muffler pipe, said foam liner having an inner surface that is substantially flush with inner surfaces of said inlet and outlet tubes, said foam liner having a minimum length sufficient to achieve exhaust air flow noise reduction and comprising polyether polyurethane foam.

2. The central vacuum cleaner of claim 1 wherein said muffler pipe comprises opposite ends, an end cap connected to each end with a reduced diameter inlet tube and reduced diameter outlet tube on a respective end cap.

3. The central vacuum cleaner of claim 2 wherein said muffler pipe, end caps, inlet tube, and outlet tube comprise plastic.

4. The central vacuum cleaner of claim 1 wherein said foam liner comprises a noise absorbing open cell foam tube inserted in said muffler pipe between said inlet and said outlet.

5. The central vacuum cleaner of claim 1 wherein said foam liner has a smooth inner surface having a fine pore structure comprising about 65 pores per lineal inch.

6. The central vacuum cleaner of claim 1 wherein the foam liner has a minimum length of about 15 inches and an inner diameter of about 2 inches.

7. A central vacuum cleaner having a muffler communicated in air flow relation to an exhaust air flow pipe, said muffler comprising an elongated muffler pipe having inlet and outlet tubes and a foam liner disposed in said muffler pipe, said foam liner having an inner surface that is substantially flush with inner surfaces of said inlet and outlet tubes and that has a fine pore structure comprising about 65 pores per lineal inch, said foam liner having a minimum length sufficient to achieve exhaust air flow noise reduction.

* * * * *